United States Patent [19]

Dumortier

[11] Patent Number: 4,980,985

[45] Date of Patent: Jan. 1, 1991

[54] EJECTOR FOR HUNTING WEAPONS

[75] Inventor: Thierry Dumortier, Hermee, Belgium

[73] Assignee: Browning SA, Herstal, Belgium

[21] Appl. No.: 413,124

[22] Filed: Sep. 27, 1989

[30] Foreign Application Priority Data

Sep. 28, 1988 [BE] Belgium ..... 8801107

[51] Int. Cl.[5] ..... F41A 15/06

[52] U.S. Cl. ..... 42/46; 42/47

[58] Field of Search ..... 42/46, 47, 48

[56] References Cited

U.S. PATENT DOCUMENTS 3,323,245 6/1967 Fukami ..... 42/48

3,882,626 5/1975 Vervier ..... 42/47

4,646,458 3/1987 Stevens ..... 42/46

*Primary Examiner*—Stephen C. Bentley

*Attorney, Agent, or Firm*—Foley & Lardner, Schwartz, Jeffery, Schwaab, Mack, Blumenthal & Evans

[57] ABSTRACT

Ejector for hunting weapons, characterized in that it shows on its rear extremity two arms (9, 10) separated from each other by a groove (8), one of the arms (9) being provided with a screw of which one of the extremities can act on the other arm (10) in order to adjust the position of this latter arm (10) in relation to its ejection sear.

6 Claims, 3 Drawing Sheets

EJECTOR FOR HUNTING WEAPONS

The invention relates to an ejector for hunting weapons, still more especially for double-barrelled hunting weapons, of the type in which the spring ejectors, are put into action on breaking the weapon by the intervention, among others, of ejection sears.

Such a known device permits in the case where the two cartridges have been fired, that the two cartridge cases are simultaneously ejected at the moment the weapon is broken, whereas in the case where one cartridge alone has been fired, only the cartridge case of the spent cartridge is ejected at the moment the weapon is broken, the other cartridge only being extracted from the barrel.

It is known that the users of these double-barrelled weapons require the simultaneity of ejection of the spent cartridges.

However, this requires, in general, a precise and expensive adjustment of the ejectors, respectively of the ejection sears and a substantial increase in the cost of assembling.

The ejector for hunting weapons according to the invention has the purpose of providing a solution to this problem and to furnish an ejector permitting the aforementioned simultaneity of ejection of the spent cartridges to be adjusted at any moment and this in an extremely simple manner.

For this purpose the ejector for hunting weapons is characterized in that it shows on its rear extremity two arms separated from each other by a groove, one of the arms being provided with a screw of which one of the extremities can act on the other arm in order to adjust the position of this latter arm in relation to its ejection sear and to so guarantee the adjustment of the moment of ejection.

The ejectors according to the invention equally allow the ejection function to be omitted, when required, and to maintain only the extraction function in order not to disturb other shooters or to be able to recuperate the empty cartridge cases easily, for example to reload them.

This second function of the ejector according to the invention is certainly much appreciated by shooters of certain shooting disciplines, notably Trap, Skeet shooters etc.

In order to show better the characteristics and advantages of the invention, some examples of the embodiment are described hereafter with reference to the enclosed drawings, in which.

Figure 1:
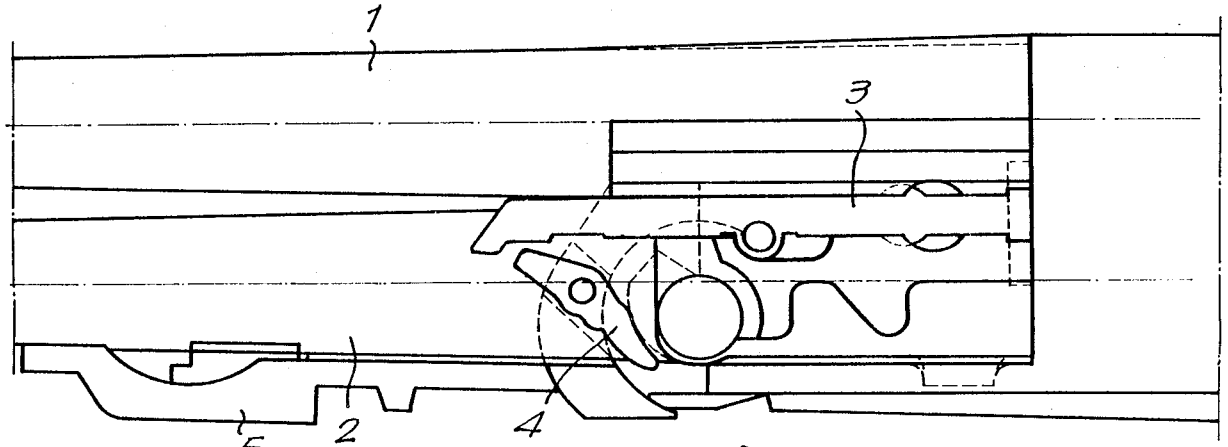
FIG. 1 shows a conventional partial view of weapon with over-and-under barrels, equipped with traditional ejectors.

In FIG. 1 a weapon with over-and-under barrels 1–2 known as such is shown.

Per barrel 1–2 an ejector 3 is provided working together with an ejection sear 4 being able to pivot between two stops created in the head of the forearm 5. These sears are each subject to the action of a spring button, not shown.

The sears work together with the faces 6 and 7, of the corresponding ejector, which must be machined in an extremely precise manner in order to ensure the simultaneity of ejection.

Figure 3:
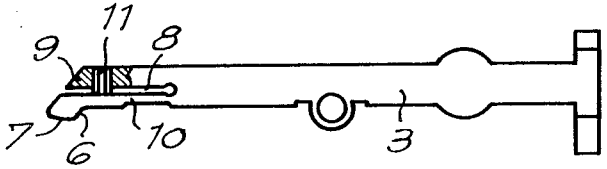
FIG. 3 shows an ejector according to the invention.

In FIG. 3 an ejector 3 according to the invention is shown.

Figure 2:
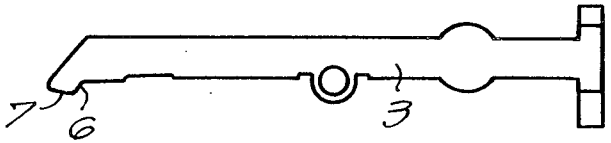
FIG. 2 shows a traditional ejector.

This one is distinguishable from a traditional ejector such as shown in FIG. 2 by the fact that it shows a groove 8 directed longitudinally on its rear part and situated in a horizontal plane in a manner to create two superimposed arms, respectively 9–10 of which one, in this case the upper arm 9, is provided with a adjusting screw 11.

This screw allows the arms 9–10 to be parted in order to be able to adjust in a very precise manner the position of the faces 6 and 7 of the ejector in relation to its sear 4, to adjust precisely in this manner the moment of releasing of the two ejectors and to synchronize perfectly the movements of the two ejectors and to eliminate in this manner the influence of wear.

As is seen from the drawings, the groove 8 is positioned in such a manner that the upper arm 9 is stiffer than the lower arm 10 which in this manner becomes more or less flexible in order to achieve that the screwing of the screw 11 only has an effect on the arm 10 which can then bend.

Figure 4:
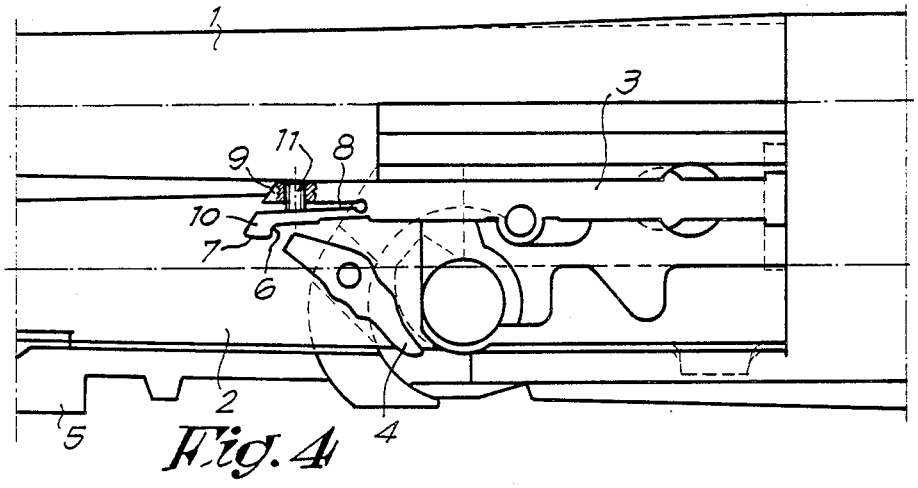
FIG. 4 shows a similar view to that of FIG. 1, the weapon being equipped with ejectors according to the invention.
Figure 5:
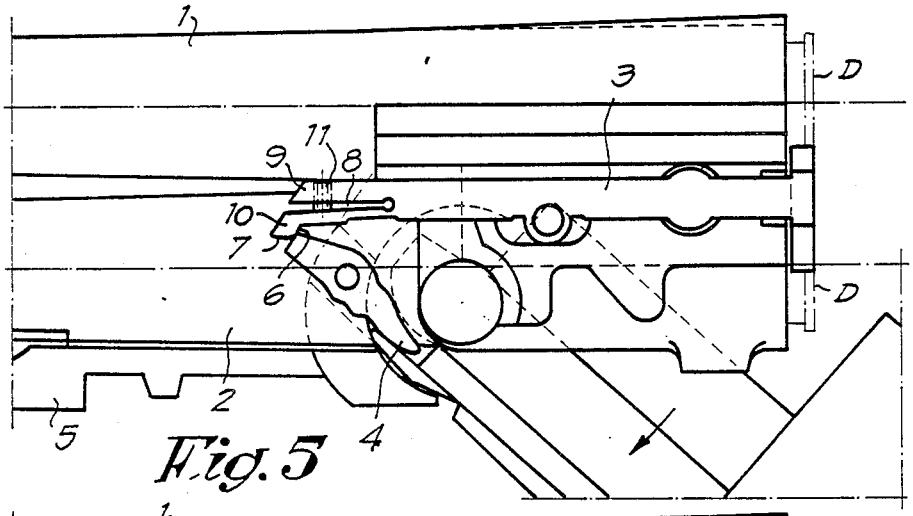
FIG. 5 shows the weapon from FIG. 4 in an intermediate broken position.
Figure 6:
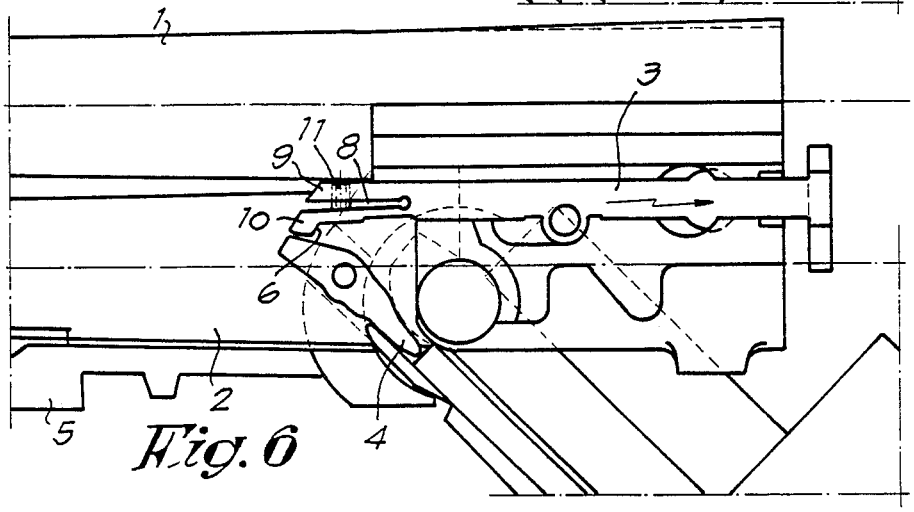
FIG. 6 shows the weapon from FIG. 4 in the broken position, the spent cartridge cases being ejected.

The adjustment shown in FIG. 4 is effected on each of the ejectors in such a manner that the ejection is simultaneous. From this adjustment results that while breaking the weapon the ejector(s) 3 stop against the corresponding sears 4 (see FIG. 5) to be released suddenly on totally breaking the weapon to achieve the ejection of the spent cartridge cases D.

Figure 7:
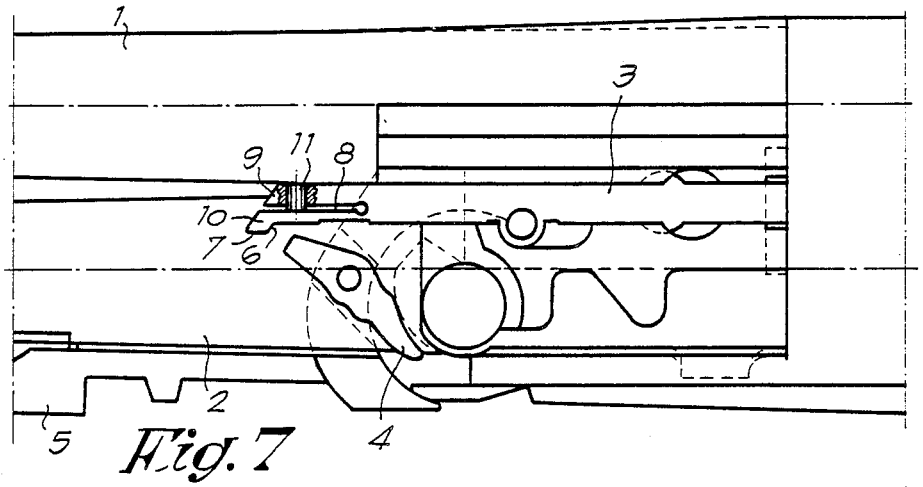
FIG. 7 shows a similar view to that of FIG. 4, the ejectors according to the invention being adjusted in such a manner that the ejection function as such is omitted.

FIG. 7 shows that it is equally possible, with the ejectors according to the invention, to omit the ejection function.

As a matter of fact, by unscrewing the adjusting screw 11, the lower arm 10 of the ejector goes back up and places itself in a position such that at no time, does it catch its ejection sear and one has then, in any case, the extraction but not the ejection of the cartridges.

Figure 8:
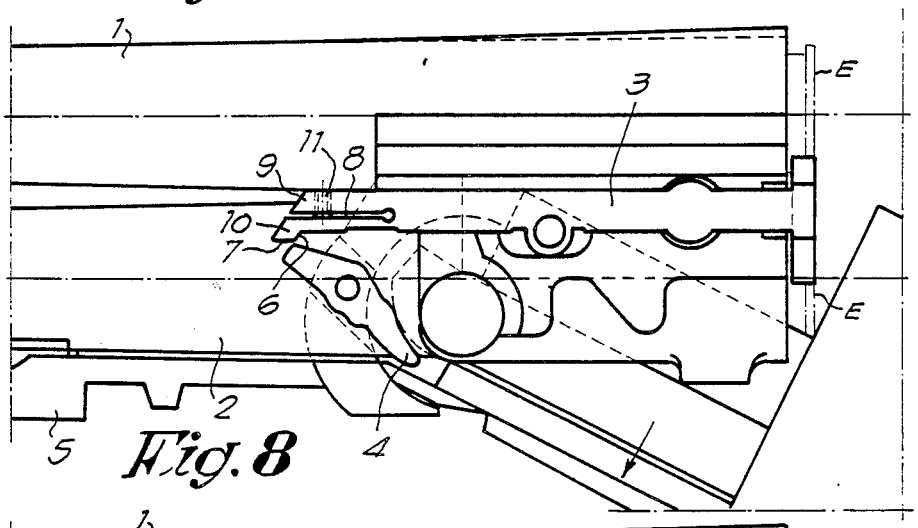
FIG. 8 shows the weapon from FIG. 7 in an intermediate broken position.
Figure 9:
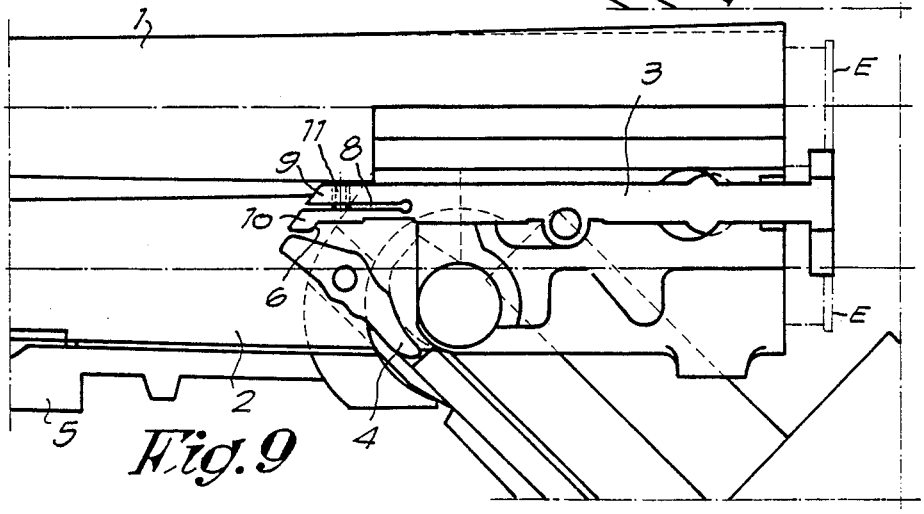
FIG. 9 shows the weapon from FIG. 7 in the broken position, the cartridge cases being only extracted from the chamber concerned.

FIGS. 8 and 9 show that the ejectors 3 are not acted upon by the sears 4 on breaking the weapon, by which simple extraction of the cartridges E whether or not spent.

It is obvious that at any time, by adjusting the screw 11, the ejection function can be recovered.

It is evident that the invention is in no way restricted to the embodiment described above and shown in the drawings. Various modifications may be made to the aforementioned embodiments, without as such departing from the scope of the invention.

I claim:

1. Ejector for hunting weapons, characterized in that it shows on its rear extremity two arms (9, 10) separated from each other by a groove (8), one of the arms (9)

being provided with a screw of which one of the extremities can act on the other arm (10) in order to adjust the position of this latter arm (10) in relation to its ejection sear.

2. Ejector according to claim 1, characterized in that the groove (8) is directed according to the length of the ejector (3).

3. Ejector according to claim 1, characterized in that the groove (8) is situated in a horizontal plane.

4. Ejector according to claim 1, characterized in that the groove (8) is positioned in such a manner that the upper arm (9) is rigid whereas the lower arm (10) is more or less flexible.

5. Ejector according to claim 1, characterized in that the screw (11) is directed perpendicularly in relation to the groove (8).

6. Ejector according to claim 5, characterized in that the extremity of the screw (11) directed towards the lower arm (10) works together freely with this arm (10).

* * * * *